US006912997B2

(12) United States Patent
Mezger et al.

(10) Patent No.: US 6,912,997 B2
(45) Date of Patent: Jul. 5, 2005

(54) METHOD AND ARRANGEMENT FOR DETERMINING A FUEL WALL FILM MASS

(75) Inventors: Werner Mezger, Eberstadt (DE); Lutz Reuschenbach, Stuttgart (DE); Faouzi Takni, Ditzingen (DE)

(73) Assignee: Robert Bosch GmbH, Stuttgart (DE)

( * ) Notice: Subject to any disclaimer, the term of this patent is extended or adjusted under 35 U.S.C. 154(b) by 141 days.

(21) Appl. No.: 10/655,295

(22) Filed: Sep. 5, 2003

(65) Prior Publication Data

US 2004/0045535 A1 Mar. 11, 2004

(30) Foreign Application Priority Data

Sep. 5, 2002 (DE) ..... 102 41 061

(51) Int. Cl.[7] ..... F02M 51/00
(52) U.S. Cl. ..... 123/480
(58) Field of Search ..... 123/704, 480, 123/434, 444

(56) References Cited

U.S. PATENT DOCUMENTS 6,220,225 B1 * 4/2001 Mencher et al. ..... 123/491

* cited by examiner

*Primary Examiner*—Bibhu Mohanty
(74) *Attorney, Agent, or Firm*—Walter Ottesen

(57) ABSTRACT

The invention is directed to a method and an arrangement for determining a fuel wall film mass in an internal combustion engine (1) having intake manifold injection. The method and arrangement provide a precise as possible transition compensation also for the case wherein the fuel injection into the open inlet valve (5) of a cylinder (20) takes place. The fuel wall film mass is determined starting from a fuel injection which takes place completely in advance of opening of the inlet valve (5) of the cylinder (20) of the internal combustion engine (1) into the intake manifold (10). The value so determined for the fuel wall film mass is corrected in dependence upon the ratio between the fuel mass, which is injected via the open inlet valve (5) into the combustion chamber (15) of the cylinder (20), and the total injected fuel mass.

7 Claims, 3 Drawing Sheets

LWOT
EÖ
ES
ZOT
360° KW

WNWREO
wtioe
woe_w
wee
WESSOT
wte
wkrf
weeotkrf
EÖ1
ES1

WNWREO1
wnwve
woe_w
wee1
wte
wkrf
weeotkrf1
wtioe

WNWREO
wee2
wte
wkrf
weeotkrf2
wtioe2

WNWREO
wee3
wte
wkrf3
weeotkrf
wtioe3

METHOD AND ARRANGEMENT FOR DETERMINING A FUEL WALL FILM MASS

BACKGROUND OF THE INVENTION

So-called wall film effects occur in internal combustion engines having intake manifold injection. The fuel, which is injected into the intake manifold, does not completely enter the combustion chamber of the engine, rather, the injected fuel partially deposits as a wall film on the intake manifold or on the injection valves. This wall film mass changes during dynamic motor operation, especially, when there are changes of load. This leads to deviations from a pregiven air/fuel mixture ratio in an exhaust-gas system of the engine. The change of the wall film mass is corrected via a model. In this way, the deviations from the pregiven air/fuel ratio in the exhaust-gas system can be compensated.

SUMMARY OF THE INVENTION

The method of the invention and the arrangement of the invention for determining a fuel wall film mass have the advantage with respect to the above that the fuel wall film mass is determined proceeding from a fuel injection which takes place completely in advance of opening an inlet valve of a cylinder of the engine into the intake manifold and that the value so determined for the fuel wall film mass is corrected in dependence upon the ratio between the fuel mass, which is injected via the open inlet valve into a combustion chamber of the cylinder, and the total injected fuel mass. In this way, changes of the air/fuel ratio in the exhaust-gas system during load changes can be prevented or compensated with the aid of a so-called transition compensation as a precontrol measure independently of whether the injected fuel mass is injected completely in advance of the opening of the inlet valve or is entirely or partially injected into an open inlet valve. In this way, a change of the fuel wall film mass is considered for the transition compensation because of an at least partial injection of fuel into the open inlet valve.

An especially simple method for determining the ratio between the fuel mass, which is injected via the open inlet valve into a combustion chamber of the cylinder, and the total injected fuel mass results when the time in which the fuel is injected via the open inlet valve into the combustion chamber is related to a total effective injection time. It is especially advantageous when, for the time in which the fuel is injected via the open inlet valve into the combustion chamber, a flying time of the fuel from an injection valve up to the inlet valve is considered. In this way, the time in which the fuel can get into the combustion chamber can be especially precisely determined and therefore an especially reliable correction of the determined fuel wall film mass can be carried out.

A further advantage is that the ratio is determined in which the crankshaft region in which the fuel is injected via the open inlet valve into the combustion chamber is related to a crankshaft angle region which is assigned to a total effective injection time in dependence upon an engine rpm. In this way, the ratio between the fuel mass, which is injected via the open inlet valve into a combustion chamber of a cylinder, and the total injected fuel mass can be determined especially simply by evaluating different crankshaft angles during the injection operation.

A further advantage is that, in dependence upon the ratio, a corrective factor for the determined values of the fuel wall film mass is determined in such a manner that, in the context of a wall film compensation with like jumps in load, equal values result for an air/fuel ratio in an exhaust-gas system of the internal combustion engine as for a complete injection of fuel in advance of the opening of the inlet valve. In this way, a simple correction of the determined fuel wall film mass is possible, which is adapted to the particular engine and therefore is especially accurate. The correction makes possible a most reliable transition compensation independently of whether the injected fuel mass is completely injected in advance of opening the inlet valve or is entirely or partially injected into the open inlet valve.

A further advantage is that the ratio is changed by the following: a change of a camshaft position for an adjustable camshaft; a change of an advance angle for an end of the fuel injection; or, a change of a flight angle which results from the flying time of the fuel leaving the injection valve until reaching the inlet valve. In this way, the fuel mass, which is injected into the open valve, can be especially flexibly varied.

BRIEF DESCRIPTION OF THE DRAWINGS

The invention will now be described with reference to the drawings wherein.

DESCRIPTION OF THE PREFERRED EMBODIMENTS OF THE INVENTION

Figure 3:
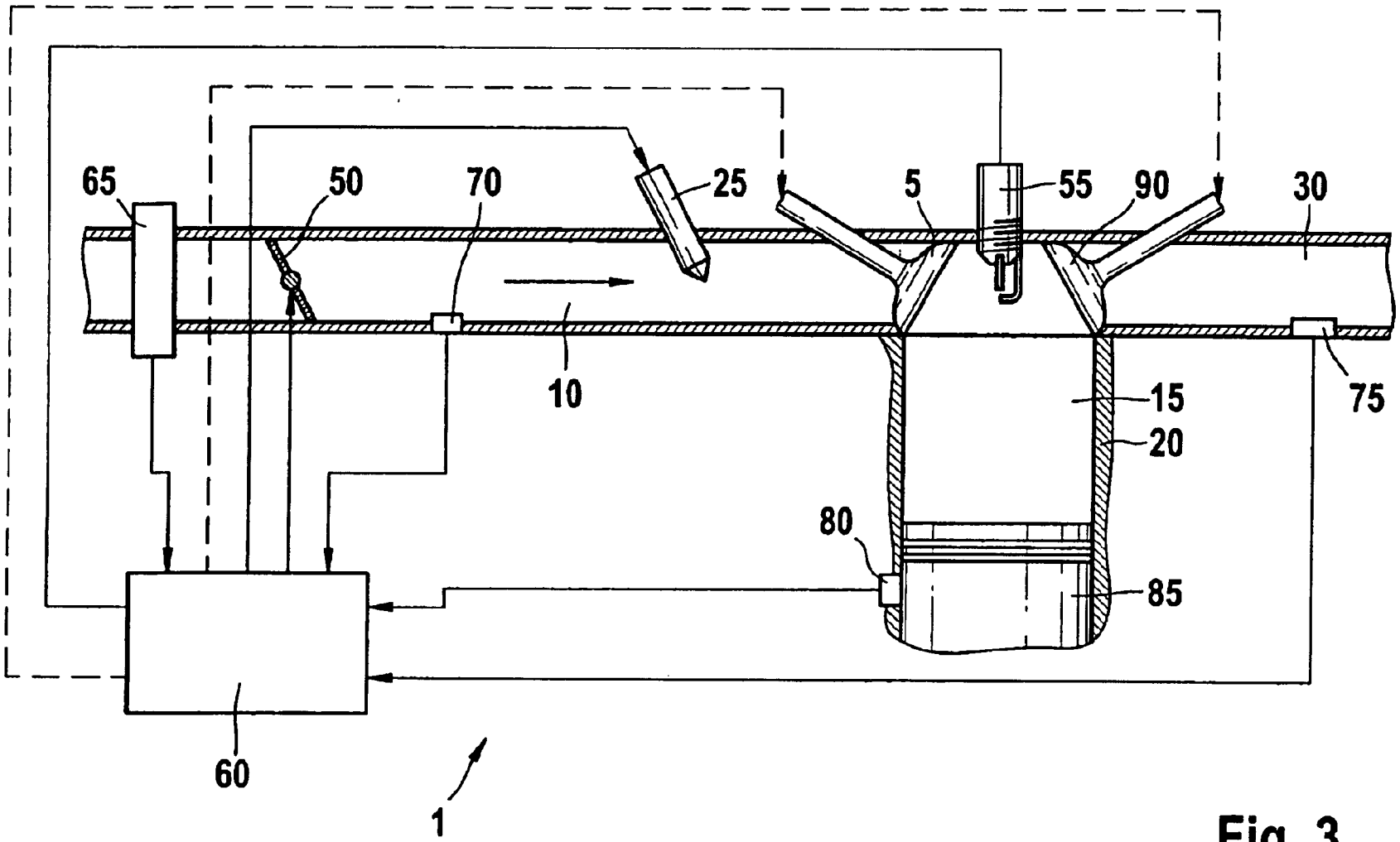

FIG. 3 is a schematic of an internal combustion engine 1 having intake manifold injection. The engine 1 includes at least one cylinder 20 having a combustion chamber 15 and a piston 85 which drives a crankshaft (not shown in FIG. 3). In the combustion chamber 15, an air/fuel mixture can be supplied from the intake manifold 10 through an inlet valve 5. The exhaust gas, which arises after combustion in the combustion chamber 15, is supplied via an outlet valve 90 to an exhaust-gas system 30. The air/fuel mixture is inducted from the intake manifold 10 into the combustion chamber 15 and is ignited by a spark plug 55. The inlet valve 5 and the outlet valve 90 can be opened or closed by a camshaft, which is driven by the crankshaft, and therefore in dependence upon the crankshaft angle of the cylinder 20. It is also possible to fully variably drive the inlet valve 5 and the outlet valve 90 via an engine control 60. For this purpose, the inlet valve 5 and the outlet valve 90 are shown connected by broken lines to the engine control 60 in FIG. 3.

The air mass, which is supplied to the intake manifold 10, is detected by an air mass measuring device 65, for example, a hot film air mass sensor, and the formed measuring signal is supplied to the engine control 60. The air supply into the intake manifold 10 can be adjusted by means of a throttle flap 50 which is driven, for example, electrically by the engine control 60. The throttle flap 50 is mounted downstream in flow direction of the air from the hot film air mass sensor 65. The flow direction of the air is shown in FIG. 3 by an arrow in the intake manifold 10. An intake manifold pressure sensor 70 is mounted downstream of the throttle flap 50 in flow direction of the air in the intake manifold 10. The pressure sensor 70 detects the pressure in the intake manifold 10 and transmits a corresponding measurement signal to the engine control 60. An injection valve 25 for injecting fuel into the intake manifold 10 is mounted in the intake manifold 10 between the inlet valve 5 and the throttle flap 50. A lambda probe 75 is mounted in the exhaust-gas system 30 and determines the oxygen content in the exhaust-gas system 30 and transmits the same to the engine control 60. From the oxygen content, the engine control 60 can determine the air/fuel ratio in the exhaust-gas system 30. Furthermore, a crankshaft angle sensor 80 is mounted on the cylinder 20 and detects the instantaneous crankshaft angle which is likewise transmitted to the engine control 60.

The views set forth here are exemplary for the cylinder 20 but can be applied in a corresponding manner to several cylinders.

Figure 1:
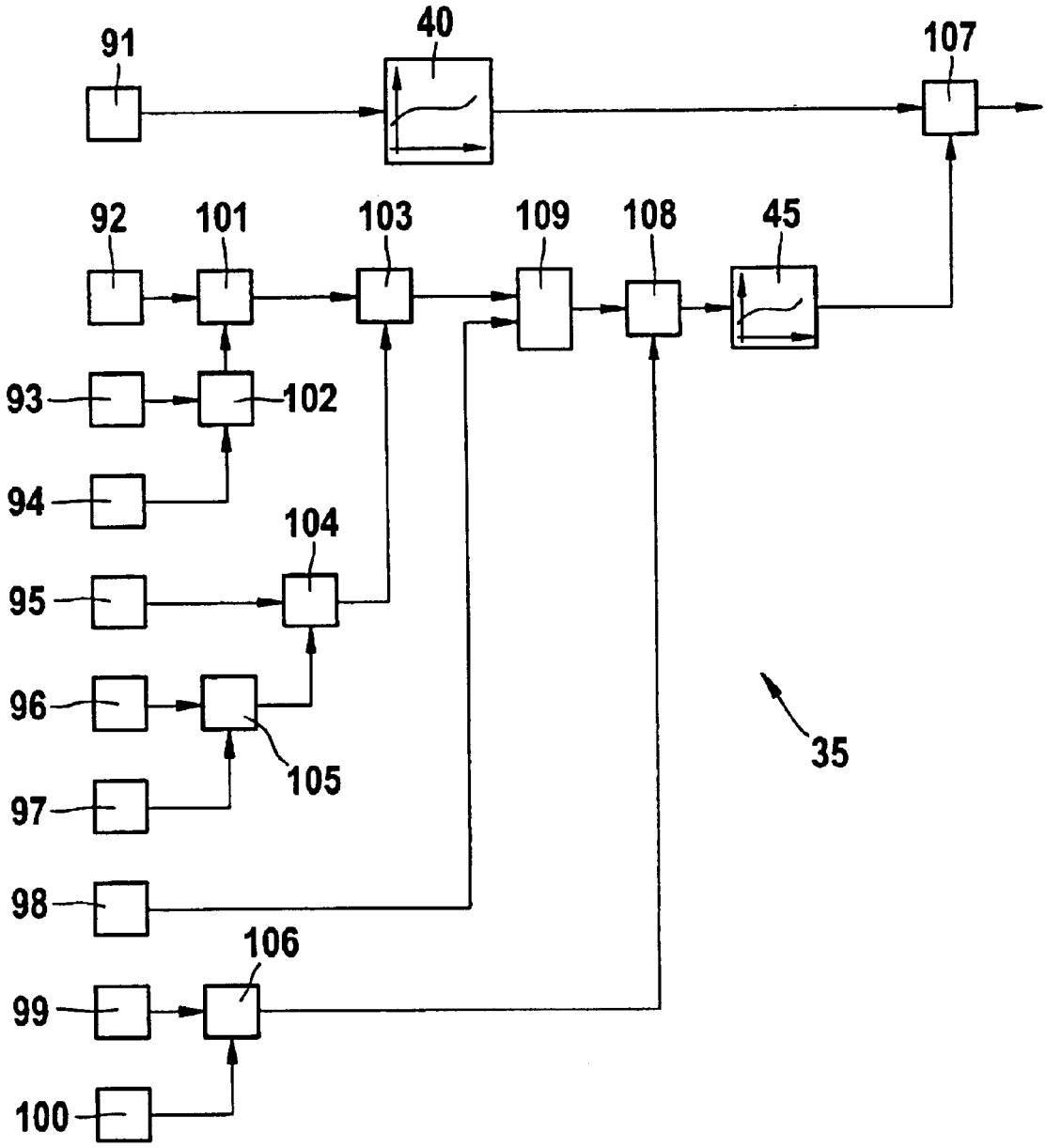
FIG. 1 is a function diagram for showing the arrangement of the invention and for explaining the method of the invention.

The engine control 60 includes a device 35 which can be implemented in the engine control 60 as hardware and/or as software. The device 35 of the invention is shown in FIG. 1 and is hereinafter characterized as a wall film determination and correction unit. The engine control 60 can determine the engine rpm of the engine 1 from the course of the crankshaft angle as a function of time with the course of the crankshaft angle being supplied by the crankshaft angle sensor 80. The engine control 60 can determine a relative charge rlp of the cylinder 20, for example, by means of a model from the following: the air mass supplied to the combustion chamber 15 and determined by the hot film air mass sensor 65; the intake manifold pressure supplied by the intake manifold pressure sensor 70; and, the engine rpm determined with the aid of the crankshaft angle sensor 80. The relative charge rlp is supplied in the wall film determination and correction unit 35 by block 91 to means 40 for determining a fuel wall film mass on the intake manifold and/or on the injection valve 25. The means 40 thereby realize a wall film characteristic line or function which converts the relative charge rlp as an input quantity into a corresponding fuel wall film mass wf as an output quantity. The wall film characteristic line is determined starting from a fuel injection which takes place completely in advance of the opening of the inlet valve 5 in the intake manifold 10. This means that the total fuel mass is prestored, that is, the fuel mass is not injected into the open inlet valve 5. Under these conditions, the wall film characteristic line is applied via load jumps which are realized by corresponding changes of the position of the throttle flap 50 and therefore by corresponding changes of the relative charge rlp. This can also take place in that for the particular position of the throttle flap (that is, the particular relative charge rlp which results therefrom), the engine control 60 drives the injection valve 5 in such a manner for varying the fuel injection quantity that the wall film effect which forms is just compensated and a change in the air/fuel ratio in the exhaust-gas system 30 (which is determined by the lambda probe 75) is just compensated. The additional quantity of fuel which is required therefore corresponds to the fuel wall film mass formed for the particular position of the throttle flap. This can then be stored in the wall film characteristic line as an output quantity for the corresponding relative charge rlp.

The fuel wall film mass wf, which is so determined by means 40, is then supplied to a third multiplication element 107.

A crankshaft angle of 360° is supplied to the arrangement 35 via block 92. This crankshaft angle characterizes the crankshaft angle position of an upper ignition dead point of the piston 85 relative to an upper charge exchange dead point of the piston 85. This crankshaft angle of 360° is supplied to a first subtraction element 101. A crankshaft angle wnwreo is supplied via block 93 to the arrangement 35 and this crankshaft angle characterizes the crankshaft angle position at the time point of the opening of the inlet valve 5 referred to the upper charge exchange dead point. The crankshaft angle wnwreo is, as a rule, fixedly pregiven or is known in the engine control 60 and is supplied to an addition element 102. A crankshaft angle WESSOT is supplied via block 94 to the arrangement 35 and characterizes the crankshaft angle position of the upper ignition dead point referred to the crankshaft angle position at the time point of closing of the inlet valve 5. The crankshaft angle WESSOT is likewise, as a rule, fixedly pregiven or is known in the engine control 60 and is likewise supplied to the addition element 102. The addition element 102 thereby forms the sum of the crankshaft angles wnwreo and WESSOT. This sum is subtracted from the crankshaft angle 360° in the first subtraction element 101. In this way, a crankshaft angle woe_w is at the output of the first subtraction member 101 and corresponds to the crankshaft angle range over which the inlet valve 5 is open, that is, from the time point of the opening of the inlet valve 5 to the time point of the closing of the inlet valve 5. The crankshaft angle woe_w is then supplied to a second subtraction element 103. A crankshaft angle wee is supplied via block 95 to the arrangement 35 and this crankshaft angle characterizes the crankshaft angle at the time point of the end of the fuel injection referred to the crankshaft angle at the time point of the closing of the inlet valve 5. The crankshaft angle wee is likewise, as a rule, fixedly pregiven or is known in the engine control 60 and is supplied to a third subtraction element 104. An angle speed vwkw of the crankshaft of the cylinder 20 is supplied via block 96 to the arrangement 35. The angle speed vwkw can be determined from the measurement signal of the crankshaft angle sensor 80 in the engine control 60. The angle speed vwkw of the crankshaft corresponds to the engine rpm of the internal combustion engine 1. The angle speed vwkw is supplied to a first multiplication element 105. A fuel flight time TKRF is supplied via block 97 to the arrangement 35 and characterizes the time which a fuel droplet requires after leaving the injection valve 25 up to arriving at the inlet valve 5. The flight time TKRF is determined in the engine control 60 in dependence upon the known injection angle and injection pressure and the known distance between the injection valve 25 and the inlet valve 5 and is likewise supplied to the first multiplication element 105. The first multiplication element 105 forms the product of the angle speed vwkw and the fuel flight time TKRF. The product formed in this manner is the crankshaft angle WKRF which corresponds to the flight time of the fuel from the injection valve 25 up to the inlet valve 5. The crankshaft angle WKRF is likewise supplied to the third subtraction element 104 and is there subtracted from the crankshaft angle wee. In this way, there results a crankshaft angle weeotkrf at the output of the third subtraction element 104. This crankshaft angle weeotkrf corresponds to the crankshaft angle at the time point of the end of the flight time referred to the crankshaft angle at the time point of the closing of the inlet valve 5. The crankshaft angle weeotkrf is supplied to the second subtraction element 103 and is there subtracted from the crankshaft angle woe_w. As a result, a crankshaft angle is present at the output of the second subtraction element 103 and this crankshaft angle corresponds to the crankshaft angle range in which the fuel can arrive at the opened inlet valve 5 which can be via injection of the fuel from the injection valve 25 after opening of the inlet valve 5 or during the flight time TKRF of the fuel. The output of the second subtraction element 103 is then supplied to a maximum selection element 109. The value 0 is supplied to the maximum selection element 109 from block 98 via another input. The maximum selection element 109 forms the maximum from 0 and the crankshaft angle supplied by the second subtraction element 103. This means that the output of the maximum selection element 109 is 0 when the output of the second subtraction element 103 is negative and therefore the fuel mass is completely injected into the intake manifold before opening of the inlet valve 5 and also no fuel is injected into the open inlet valve 5 while considering the flight time TKRF of the fuel. If, in contrast, the output of the second subtraction element 103 is positive, then the output of the second subtraction element 103 corresponds to the output of the maximum selection element 109 which, in turn, is supplied to a division element 108. The angle speed vwkw is, in turn, supplied via block 99 to the arrangement 35. In this case, the angle speed vwkw is supplied to a second multiplication element 106. A total effective injection time te_w is supplied via block 100 to the arrangement 35. This time corresponds to the time in which the injection valve 25 is opened and is fixedly pregiven or is known in the engine control 60. The total effective injection time te_w is likewise supplied to the second multiplication element 106.

In the second multiplication element 106, the product of the angle speed vwkw and the total effective injection time te_w is formed. The product is a crankshaft angle wte which corresponds, at the instantaneous angle speed vwkw, to the total effective injection time te_w. The crankshaft angle wte is then likewise supplied to the division element 108. In the division element 108, the output of the maximum selection element 109 and therefore the crankshaft angle region, in which the fuel, which is injected by the injection valve 25, can arrive at the open inlet valve 5, is divided by the crankshaft angle wte and therefore by the crankshaft angle region for the entire effective injection time. The result is a ratio vti of the fuel mass, which is injected via the open inlet valve 5 into the combustion chamber 15 of the cylinder 20, referred to the total injected fuel mass. This ratio therefore corresponds to the ratio of the crankshaft angle range over which the fuel is injected via the open inlet valve 5 into the combustion chamber 15 referred to the crankshaft angle range in which the total fuel injection takes place.

The ratio of vti corresponds furthermore to the ratio of the time in which the fuel is injected into the combustion chamber 15 via the open inlet valve 5 referred to the total effective injection time te_w. The ratio vti is supplied as an input quantity to means 45 for correcting the determined fuel wall film mass. The means 45 include a correction function or correction characteristic line and the ratio vti is converted into an output quantity ftineo based on this corrective characteristic line. The output quantity ftineo defines a corrective factor for the fuel wall film mass and is likewise supplied to the third multiplication element 107.

For the application of the corrective characteristic line or correction factor ftineo, the injection over the crankshaft angle wee can, for example, be so displaced to a later time point that at least a part of the fuel mass arrives in the combustion chamber 15 via the open inlet valve 5. The crankshaft angle wee can also be characterized as a prestorage angle. The corrective characteristic line is then so applied in dependence upon the ratio vti that, in the context of a wall film compensation for equal load jumps, the same values result for the air/fuel ratio in the exhaust-gas system 30 of the engine 1 as for a complete injection of fuel in advance of opening the inlet valve 5. The corrective factor ftineo for the fuel wall film mass is then applied in dependence upon the ratio vti in such a manner that a compensated fuel wall film mass, which is corrected by the corrective factor ftineo, ensures the required transition compensation of the changes of the air/fuel mixture in the exhaust-gas system 30 for changes of load. For this purpose, the corrective factor ftineo is multiplied in the third multiplication element 107 by the output of the means 40 and therefore by the determined fuel wall film mass wf in order to determine a corrected fuel wall film mass dwf.

For the case that there is no injection into the open inlet valve 5, the ratio vti is equal to 0 and the corrective factor ftineo is equal to 1 so that no correction of the fuel wall film mass takes place. When the ratio vti is equal to 1, then the total fuel mass is injected into the open inlet valve 5. The corrective factor ftineo is then correspondingly less than 1 because, in this case, less fuel wall film mass is formed.

With the function diagram of FIG. 1, the following equation is realized for the ratio vti:

$$vti = \frac{\max[0,(360\ [^\circ\ \mathrm{KW}] - WNWREO\ [^\circ\ \mathrm{KW}] - WESSOT\ [^\circ\ \mathrm{KW}] - wee\ [^\circ\ \mathrm{KW}] + wkrf\ [^\circ\ \mathrm{KW}])]}{vwkw\ [^\circ\ \mathrm{KW/ms}] * \mathrm{te_w}\ [\mathrm{ms}]} \tag{1}$$

wherein ° KW is the crankshaft angle in degrees.

If the ratio vti is computed in the time region, then the ratio results as follows:

$$vti = \frac{tioe + tkrf}{\mathrm{te_w}} \tag{2}$$

wherein: tioe is the time in which the fuel is injected from the injection valve 25 and simultaneously the inlet valve 5 is opened. The sum in the counter of the equation (2) corresponds to the time in which the fuel is injected into the combustion chamber 15 via the opened inlet valve 5. The flight time TKRF of the fuel from the injection valve 25 to the inlet valve 5 is considered.

When computing the ratio vti in accordance with the function diagram of FIG. 1, the injected fuel mass is divided into two parts. The time point at which the inlet valve 5 is opened is taken as a reference point.

In the described model, it is assumed that the fuel wall film mass must be corrected when at least a part of the injected fuel mass is injected into the open inlet valve 5. The subdivision of the injected fuel mass is therefore defined by the ratio vti. The ratio vti is therefore the injected fuel mass, which reaches the combustion chamber 15 through the open inlet valve 5, related to the total injected fuel mass. By fixing as a reference point the time point at which the inlet valve 5 opens, the flight time TKRF of the fuel but also a possible shift of the time point at which the inlet valve 5 opens, must be considered in the subdivision of the fuel referred to this time point as described. The shift of the time point is caused by the camshaft or by a fully variable valve control on the part of the engine control 60.

A displaceable camshaft for the inlet valve 5 has (for a displacement in the advance direction) the same effect as the displacement of the injection time point via the prestorage angle wee toward retard. With the displacement of the camshaft for the inlet valve 5 toward advance, the inlet valve 5 opens earlier. For a constant time point for the injection start, more fuel reaches the combustion chamber 15 via the open inlet valve 5. If the injection time point is displaced toward late or retard via the advance storage angle wee, then the injection of the fuel starts later. For a constant time point for the opening of the inlet valve 5, more fuel arrives in the combustion chamber 15 through the open inlet valve.

Generally, the ratio vti can be changed by three influence quantities, namely:

(a) a change of the camshaft position for the opening of the inlet valve 5 for a shiftable camshaft for the inlet valve 5 by a crankshaft angle wnwve and therefore a change of the time point at which the inlet valve 5 opens;

(b) a change of the advance storage angle wee for the end of the fuel injection referred to the crankshaft angle at which the inlet valve 5 closes; and, (c) a change of the flight angle wkrf, which results from the flight time of the fuel droplets from leaving the injection valve 25 until reaching the inlet valve 5, in dependence upon the angular speed vwkw.

In FIGS. 2*a* to 2*d*, four examples are shown for influencing the ratio vti based on the above-mentioned three influences. All four examples are arranged in the same crankshaft angle referred to one work cycle of the cylinder 20. ZOT characterizes the top ignition dead point of the piston 85 and LWOT characterizes the upper charge exchange dead point of the piston 85. The upper dead point ZOT and the upper charge exchange dead point LWOT are spaced from each other by a crankshaft angle of 360°. Between the top ignition dead point ZOT and the top charge exchange dead point LWOT, there is a crankshaft angle position EÖ at which the inlet valve 5 opens. A crankshaft angle position ES for the closing of the inlet valve 5 follows the crankshaft angle position EÖ for the opening of the inlet valve 5. The position of the upper ignition dead point ZOT and the upper charge exchange dead point LWOT are the same in all four examples. The position of the crankshaft angle EÖ for the opening of the inlet valve 5 and the position of the crankshaft angle ES for the closing of the inlet valve 5 is the same in FIGS. 2*a*, 2*c* and 2*d*.

Figures 2A, 2B, 2C, 2D:
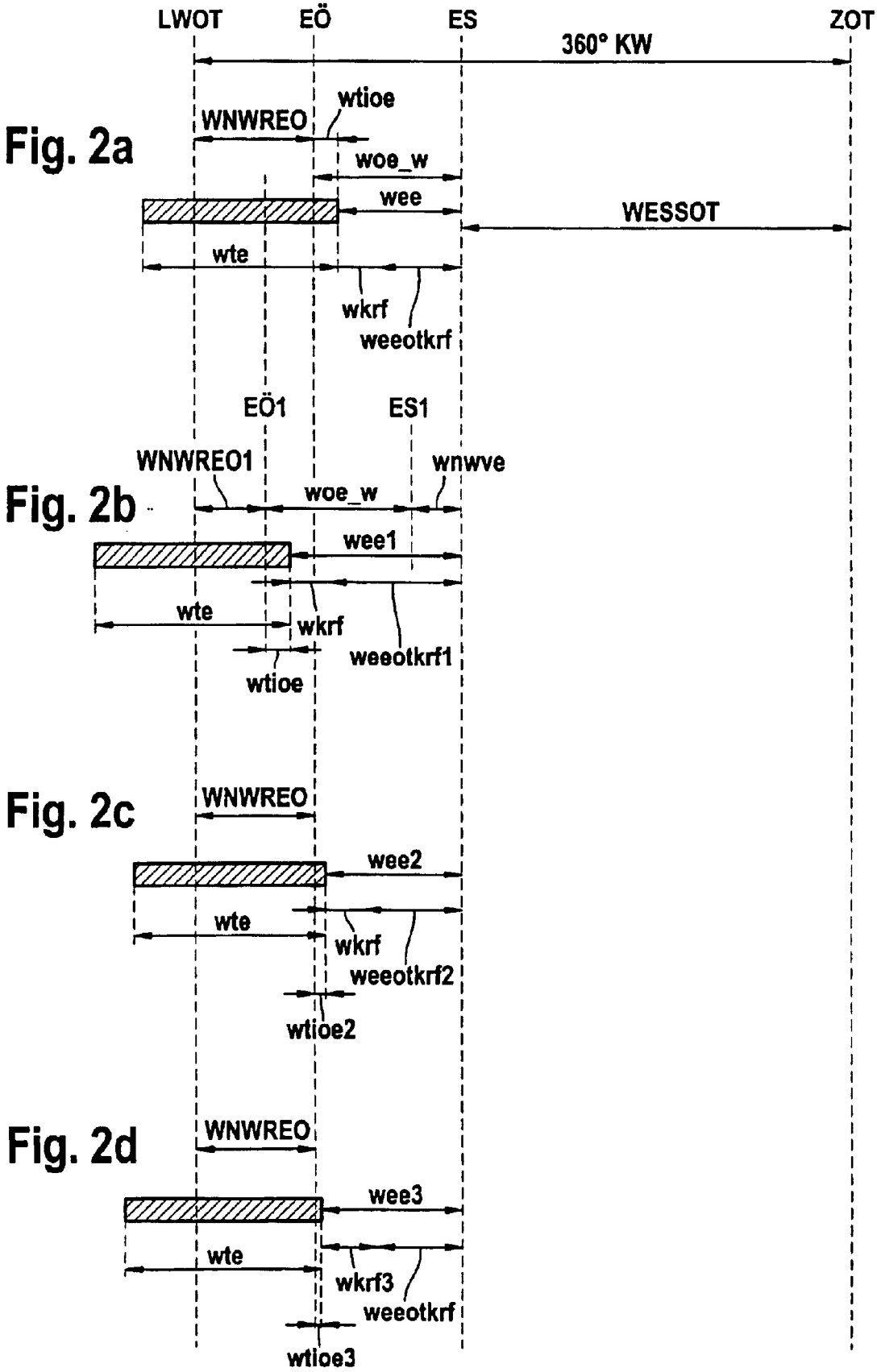
FIGS. 2*a* to 2*d* show respectively different possibilities for varying the fuel injection into an open inlet valve; and, FIG. 3 is a schematic view of an internal combustion engine having intake manifold injection.

In a first example of FIG. 2*a*, the injection of fuel from the injection valve 25 takes place during the total effective injection time te_w and is shown hatched in FIG. 2*a*. The corresponding crankshaft angle region is characterized by the crankshaft angle wte. Likewise shown is the crankshaft angle region WNWREO between the upper charge exchange dead point and the crankshaft angle EÖ at which the inlet valve 5 opens. Also shown is the crankshaft angle region woe_w between the crankshaft angle EÖ and the crankshaft angle ES which characterizes the crankshaft angle region over which the inlet valve 5 is open. The advance storage angle wee between the end of the fuel injection and the crankshaft angle at which the inlet valve 5 closes is also shown. This is composed, as described, of the crankshaft angle wkrf, which characterizes the advance storage angle for the flight time, and the crankshaft angle weeotkrf which considers the advance storage angle without flight time as shown in FIG. 2*a*. Also shown for all four examples is the crankshaft angle WESSOT between the crankshaft angle for the closing of the inlet valve 5 and the upper ignition dead point ZOT. In FIG. 2*a*, the crankshaft angle wtioe is also shown which corresponds to the crankshaft angle region wherein the fuel injection takes place from the injection valve 25 when the inlet valve 5 is open.

The ratio vti in accordance with FIG. 2*a* is then computed as follows:

$$vti = \frac{wtioe + wkrf}{wte} \tag{3}$$

According to FIG. 2*b*, it is now provided to shift the crankshaft angle for the opening of the inlet valve 5 by the value wnwve by changing the camshaft position to early and to shift the crankshaft angle for closing the inlet valve 5 also by the value wnwve by a change of the crankshaft position toward advance or early. In this way, there results a crankshaft angle EÖ1 for the opening of the inlet valve 5 which is shifted relative to the crankshaft angle EÖ for the opening of the inlet valve 5. Correspondingly, there results a crankshaft angle ES1 for the closing of the inlet valve 5 which is shifted by the crankshaft angle wnwve toward advance relative to the crankshaft angle ES for the closing of the inlet valve 5. In this way, and as described, a greater part of the fuel compared to FIG. 2*a* is injected into the open inlet valve 5 for a constant crankshaft angle. This can be countered when the advance storage angle wee is increased by the crankshaft angle wnwve so that a second advance storage angle weel results which likewise shifts the crankshaft angle region wte for the fuel injection likewise by the crankshaft angle wnwve toward advance. In this way, the crankshaft angle range wtioe for the injection of fuel into the open inlet valve 5 is unchanged. Also, the crankshaft angle region wkrf for the flight time remains unchanged as does the crankshaft angle region wte for the total effective injection. Since the advance storage angle increases by the crankshaft angle wnwve, there results, however, also a second advance storage angle weeotkrf1 without flight time which is increased relative to the first advance storage angle weeotkrf without flight time by the crankshaft angle wnwve. Because of the change of the camshaft position by the crankshaft angle wnwve, a new crankshaft angle region WNWREO1 results between the upper charge exchange dead point LWOT and the new crankshaft angle EÖ1 for the opening of the inlet valve 5. The crankshaft angle WESSOT also increases to WESSOT+wnwve. Since, however, the crankshaft angles wtioe and wkrf and wte remain unchanged by the above measures, the ratio vti also does not change.

In the third example of FIG. 2*c*, the crankshaft angle EÖ, which is described in FIG. 2*a*, is again used for the opening of the inlet valve 5 and the crankshaft angle ES is again used for the closing of the inlet valve 5 so that the crankshaft angle region WNWREO between the upper charge exchange dead point LWOT and the crankshaft angle EÖ for the opening of the inlet valve 5 assumes the value known from FIG. 2*a*. Furthermore, it should be assumed that the crankshaft angle region wte for the total effective injection should remain unchanged also in FIG. 2*c*.

In the example of FIG. 2*c*, a third advance angle wee2 is, however, selected which is greater than the first advance angle wee from FIG. 2*a* so that the fuel injection is shifted toward early and a second crankshaft angle region wtioe2 results for the injection of fuel into the open inlet valve 5 which, compared to the crankshaft angle region wtioe of FIGS. 2*a* and 2*b* is less. For the examples of FIGS. 2*a*, 2*b* and 2*c*, it should be assumed that the angular speed vwkw and therefore the engine rpm of the internal combustion engine 1 remains constant. For this reason, in all three cases, the advance angle wkrf with flight time is the same. With a reduced second crankshaft angle region wtioe2 for the injection into the open inlet valve 5 and for a constant crankshaft angle region wte for the total effective injection, the ratio vti therefore reduces relative to the example of FIGS. 2*a* and 2*b*.

In the example of FIG. 2*c*, the third advance angle wee2 was increased relative to the first advance angle wee of FIG. 2*a* and the advance angle wkrf without flight time is the same as in the example of FIG. 2*a*. For this reason, in the example of FIG. 2*c*, a third advance angle weeotkrf2 without flight time results which is increased by the same amount as the third advance angle wee2.

If, in the example of FIG. 2*c*, one would reduce the advance angle relative to the value known from FIG. 2*a*, then, in a corresponding manner, one could increase the component of the fuel, which is conducted into the open inlet valve 5, referred to the total effective injected fuel and therefore increase the ratio vti insofar as the crankshaft angle range wte likewise remains constant for the total effective injection as in the example of FIG. 2*a*. This takes place at constant flight angle or advance angle wkrf with flight time.

In the example of FIG. 2*d*, the crankshaft angle EÖ for the opening of the inlet valve 5 and the crankshaft angle ES for the closing of the inlet valve 5 of FIG. 2*a* are again used so that the crankshaft angle region WNWREO between the upper charge exchange dead point LWOT and the crankshaft angle EÖ for the opening of the inlet valve 5 are equal to the example of FIG. 2*a*. In the example of FIG. 2*d*, the crankshaft region wte for the total effective injection should be left unchanged.

In the example of FIG. 2*d*, it should be assumed that the engine rpm of the internal combustion engine 1 and therefore the angle speed vwkw was increased so that, during the fuel flight time, a greater crankshaft angle is passed through. This means that a larger second advance angle wkrf3 with flight time results relative to FIGS. 2*a* to 2*c*. In order not to change the ratio of vti compared to the example of FIG. 2*a*, the advance angle weeotkrf without flight time is left unchanged relative to the example of FIG. 2*a*. This means that, in the example of FIG. 2*d*, a fourth advance angle wee3 must be formed which is increased by the same amount relative to the advance angle wee of FIG. 2*a* as the second advance angle wkrf3 with flight time compared to the first advance angle wkrf with flight time according to FIGS. 2*a* to 2*c*. Correspondingly, the fuel injection is shifted to early so that a third crankshaft region wtieo3 for the injection of fuel into the open inlet valve 5 results which is less by the amount relative to the first crankshaft angle region wtioe from FIGS. 2*a* and 2*b* that the second advance angle wkrf3 with flight time is increased relative to the first advance angle wkrf with flight time.

If, in the example of FIG. 2*d*, the engine rpm and therefore the angle speed vwkw would reduce, then correspondingly, also the flight angle would decrease relative to the example of FIG. 2*a*. With a constant first advance angle wee of FIG. 2*a* and a constant crankshaft angle region wte for the total effective injection, the ratio vti decreases. The advance angle weeotkrf without flight time would correspondingly increase compared to the example of FIG. 2*a*. For constant fuel flight time, a larger crankshaft angle would be passed through at higher engine rpm than at lower engine rpm.

From the four examples described, it can be seen by way of example how the ratio vti can be varied in dependence upon the three above-mentioned influence quantities, namely: the change of the camshaft position for a shiftable camshaft of the inlet valve 5; the change of the advance angle for the end of the injection operation; and, the change of the flight angle and therefore of the advance angle with flight time.

As described, the fuel mass, which is injected by injection valve 25, is not always completely prestored but is partially or even entirely injected into the open inlet valve 5. The fuel component, which is injected into the open inlet valve 5, does not contribute or only contributes slightly to the fuel wall film mass. This is considered in accordance with the invention with the correction by means of the corrective factor ftineo. With this corrective factor ftineo, the ratio of the fuel mass, which is injected into the open inlet valve 5, referred to the total fuel mass injected from the injection valve 25 into the intake manifold 10, is considered.

It is understood that the foregoing description is that of the preferred embodiments of the invention and that various changes and modifications may be made thereto without departing from the spirit and scope of the invention as defined in the appended claims.

What is claimed is:

1. A method for determining a fuel wall film mass in an internal combustion engine having intake manifold injection, the method comprising the steps of:

determining a value of the fuel wall film mass which proceeds from a fuel injection with said fuel injection taking place completely in advance of the opening of an inlet valve of a cylinder of said engine;

forming the ratio between the fuel mass injected into the combustion chamber via the open inlet valve and the total injected fuel mass; and, correcting said value of the fuel wall film mass in dependence upon said ratio.

2. The method of claim 1, wherein said ratio is determined in that the time, in which the fuel is injected into said combustion chamber, is related to a total effective injection time.

3. The method of claim 2, wherein a flight time of the fuel from the injection valve to said inlet valve is considered in the time wherein the fuel is injected into the combustion chamber via the open inlet valve.

4. The method of claim 1, wherein said ratio is determined in that the crankshaft angle region, in which the fuel is injected into said combustion chamber via said open inlet valve, is related to a crankshaft angle region, which is assigned to a total effective injection time in dependence upon an engine rpm.

5. The method of claim 1, wherein a corrective factor for said value of said fuel wall film mass is determined in dependence upon said ratio in such a manner that, in the context of wall film compensation, the same values for an air/fuel ratio result in an exhaust-gas system of said engine for like jumps in load, as for a complete injection of fuel in advance of opening said inlet valve.

6. The method of claim 1, wherein said ratio is changed by: a change of camshaft position when said camshaft can be shifted; a change of an advance storage angle for an end of the fuel injection; or, a change of a flight angle which results from a flight time of the fuel from leaving the injection valve up to reaching said inlet valve.

7. An arrangement for determining a fuel wall film mass in an internal combustion engine having intake manifold injection, the arrangement comprising:

means for determining the fuel wall film mass proceeding from a fuel injection with said fuel injection taking place completely in advance of the opening of an inlet valve of a cylinder of said engine;

means for forming the ratio between the fuel mass injected into the combustion chamber via the open inlet valve and the total injected fuel mass; and, means for correcting said value of the fuel wall film mass in dependence upon said ratio.

* * * * *